US007540276B2

(12) United States Patent
Makino

(10) Patent No.: US 7,540,276 B2
(45) Date of Patent: Jun. 2, 2009

(54) FUEL-VAPOR DISCHARGE STRUCTURE IN A FUEL TANK FOR ENGINE APPARATUS

(75) Inventor: Satoshi Makino, Shizuoka-ken (JP)

(73) Assignee: Yamaha Motor Power Products Kabushiki Kaisha, Shizuoka (JP)

( * ) Notice: Subject to any disclaimer, the term of this patent is extended or adjusted under 35 U.S.C. 154(b) by 190 days.

(21) Appl. No.: 11/511,525

(22) Filed: Aug. 28, 2006

(65) Prior Publication Data

US 2008/0178851 A1 Jul. 31, 2008

(30) Foreign Application Priority Data

Aug. 26, 2005 (JP) ..... 2005-246306

(51) Int. Cl.
*F02M 33/02* (2006.01)
*F02M 33/04* (2006.01)

(52) U.S. Cl. ..... 123/518

(58) Field of Classification Search ..... 123/520, 123/519, 518, 516; 137/840, 171, 179, 213, 137/216, 216.2, 583, 587, 588, 589, 43; 220/746
See application file for complete search history.

(56) References Cited

U.S. PATENT DOCUMENTS 2,544,820 A * 3/1951 Baker et al. ..... 137/587
4,312,649 A * 1/1982 Fujii et al. ..... 96/109
5,245,974 A * 9/1993 Watson et al. ..... 123/518
5,542,706 A * 8/1996 Kubly ..... 280/833
6,946,071 B2 * 9/2005 Ehara et al. ..... 210/416.4
2008/0041348 A1 * 2/2008 Grant et al. ..... 123/519

FOREIGN PATENT DOCUMENTS

JP 07-301353 11/1995

* cited by examiner

*Primary Examiner*—Mahmoud Gimie
(74) *Attorney, Agent, or Firm*—Knobbe, Martens, Olson & Bear, LLP

(57) ABSTRACT

A fuel tank has a fuel-vapor discharge structure in which the piping connecting to external equipment is not obtrusive. The fuel-vapor discharge structure allows the passage of fuel vapor between an upper space in the fuel tank and an induction system. The communication passage can be formed by a communication tube arranged vertically within the interior of the fuel tank and a connecting tube located outside the fuel tank. A lower portion of the fuel tank includes a one-way valve which allows fuel vapor to flow from the fuel tank to the induction system.

29 Claims, 4 Drawing Sheets

FUEL-VAPOR DISCHARGE STRUCTURE IN A FUEL TANK FOR ENGINE APPARATUS

RELATED APPLICATIONS

The present application is based on and claims priority under 35 U.S.C. § 119(a)-(d) to Japanese Patent Application No. 2005-246306, filed on Aug. 26, 2005, the entire contents of which is hereby expressly incorporated by reference herein.

BACKGROUND OF THE INVENTION

1. Field of the Invention

The present invention relates to a fuel-vapor discharge structure for a fuel tank.

2. Description of the Related Art

Known fuel vapor structures have been used with fuel tanks for discharging fuel vapors. The discharged fuel vapor is routed to an engine intake system (see, for example, Japanese Patent Abstract 07-301353). The fuel vapor discharge structure includes a cylindrical main body having a two-way valve and a fuel cut-off valve mechanism. The outer periphery of the main body includes a flange portion. The two-way valve is arranged within the case main body and above the flange portion. The fuel cut-off valve mechanism is arranged within the case main body and below the flange portion.

The fuel vapor discharge structure is incorporated into the fuel tank by attaching the flange portion to the top surface of the fuel tank at the same location where the fuel cut-off valve mechanism is inside the fuel tank and the two-way valve is located outside of the fuel tank. Further, the upper portion of the main body has a vent port. A pipe connects the two-way valve and external canister to the vent port. The two-way valve has a positive pressure valve mechanism and a negative pressure valve mechanism. The two-way valve adjusts the pressure within the fuel tank in a predetermined range by ventilating the fuel vapor in both directions between the fuel tank and the canister. Further, the fuel cut-off valve mechanism prevents fuel from flowing into the canister even when there is change in the liquid level of the fuel tank.

In the fuel discharge structure above, the pipe connecting together the vent port and the canister is located above the top surface of the fuel tank. However, for engines having an engine generator or a general-purpose engine, the fuel tank is often arranged on the top of the apparatus with its top surface exposed to the outside. When the above-described fuel vapor discharge structure is used with such an engine, the pipe connecting the vent port to the canister lies across the top surface of the apparatus and is obtrusive when a user is operating or working on the engine apparatus.

SUMMARY OF THE INVENTION

In view of the foregoing, a need exists for a fuel discharge structure having pipes that connect to external equipment without being obtrusive.

An aspect of the invention is directed to a fuel-vapor discharge structure for a fuel tank. The structure includes a communication passage that is between an upper space of the fuel tank and outside the fuel tank. The structure further includes an extraction portion. The extraction portion disposed at a bottom of the fuel tank. A portion of the communication passage extends between the upper space and the extraction portion of the fuel tank.

An aspect of the invention is directed to a fuel-vapor discharge system for a fuel tank. The system includes a communication passage that runs between an inside and outside of a fuel tank. A portion of the communication passage is disposed within the fuel tank. The system further includes an extraction portion that is disposed at the bottom of the fuel tank.

An aspect of the invention is directed to a fuel tank for an engine generator. The fuel tank includes a lower surface, an internal upper region, and a member. The member has an internal passageway that extends between the upper region and the bottom surface. At least a portion of the member is disposed within the fuel tank. The fuel tank further includes an extraction portion that is disposed on the bottom surface and in flow communication with internal passageway.

The systems and methods of the invention have several features, no single one of which is solely responsible for its desirable attributes. Without limiting the scope of the invention as expressed by the claims, its more prominent features have been discussed briefly above. After considering this discussion, and particularly after reading the section entitled "Detailed Description of the Preferred Embodiments," one will understand how the features of the system and methods provide several advantages over conventional fuel vapor discharge structures.

BRIEF DESCRIPTION OF THE DRAWINGS

These and other features, aspects and advantages of the present invention will now be described in connection with preferred embodiments of the invention, in reference to the accompanying drawings. The illustrated embodiments, however, are merely examples are not intended to limit the invention. The following are brief descriptions of the drawings.

DETAILED DESCRIPTION OF THE PREFERRED EMBODIMENTS

The following detailed description is now directed to certain specific embodiments of the invention. In this description, reference is made to the drawings wherein like parts are designated with like numerals throughout the description and the drawings.

Figure 1:
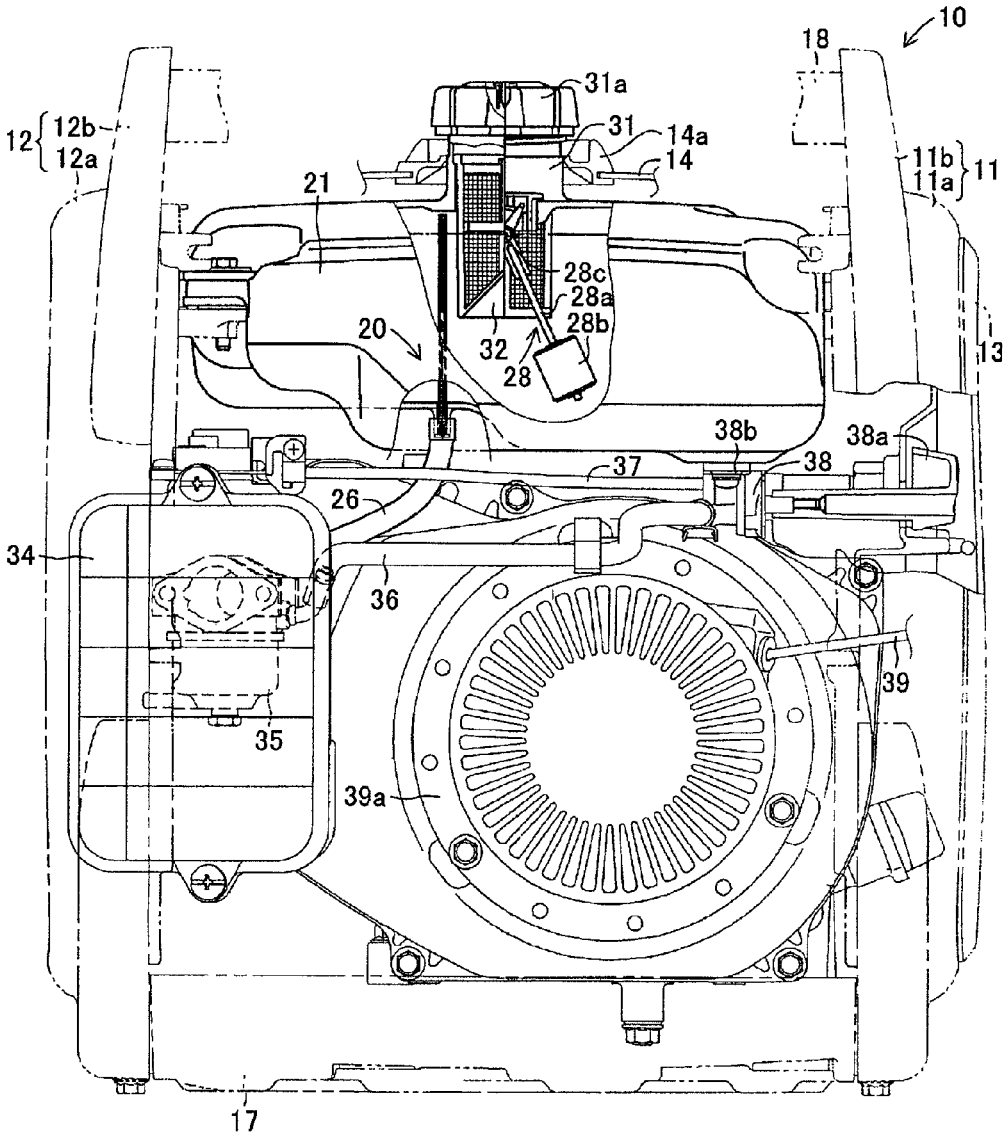
FIG. 1 is a partially cutaway side view of an engine generator configured in accordance with a preferred embodiment of the present invention.

FIG. 1 is a partially cutaway side view of an engine generator 10 configured in accordance with a preferred embodiment of the present invention. The terms "top," "upper," "bottom," "back," "front" and the like, which also are used to describe the present engine generator, are used in reference to the illustrated orientation of the embodiment. With respect to the orientation of the engine generator 10 in FIG. 1, the terms "top" or "upper" describes the portion of the engine generator 10 that is located near the top of FIG. 1. The term "bottom" describes the portion of the engine generator 10 that is located near the bottom of FIG. 1. The term "back" describes the portion of the engine generator 10 that is located on the left side of FIG. 1. The term "front" describes the portion of the engine generator 10 that is located on the right side of FIG. 1. The engine generator 10 has generally a rounded, substantially box-like shape formed by a front frame 11, a rear frame 12, a front panel 13, a top panel 14, an intake cover 15, an exhaust cover 16, a back panel (not shown), and a bottom panel 17.

Figure 2:
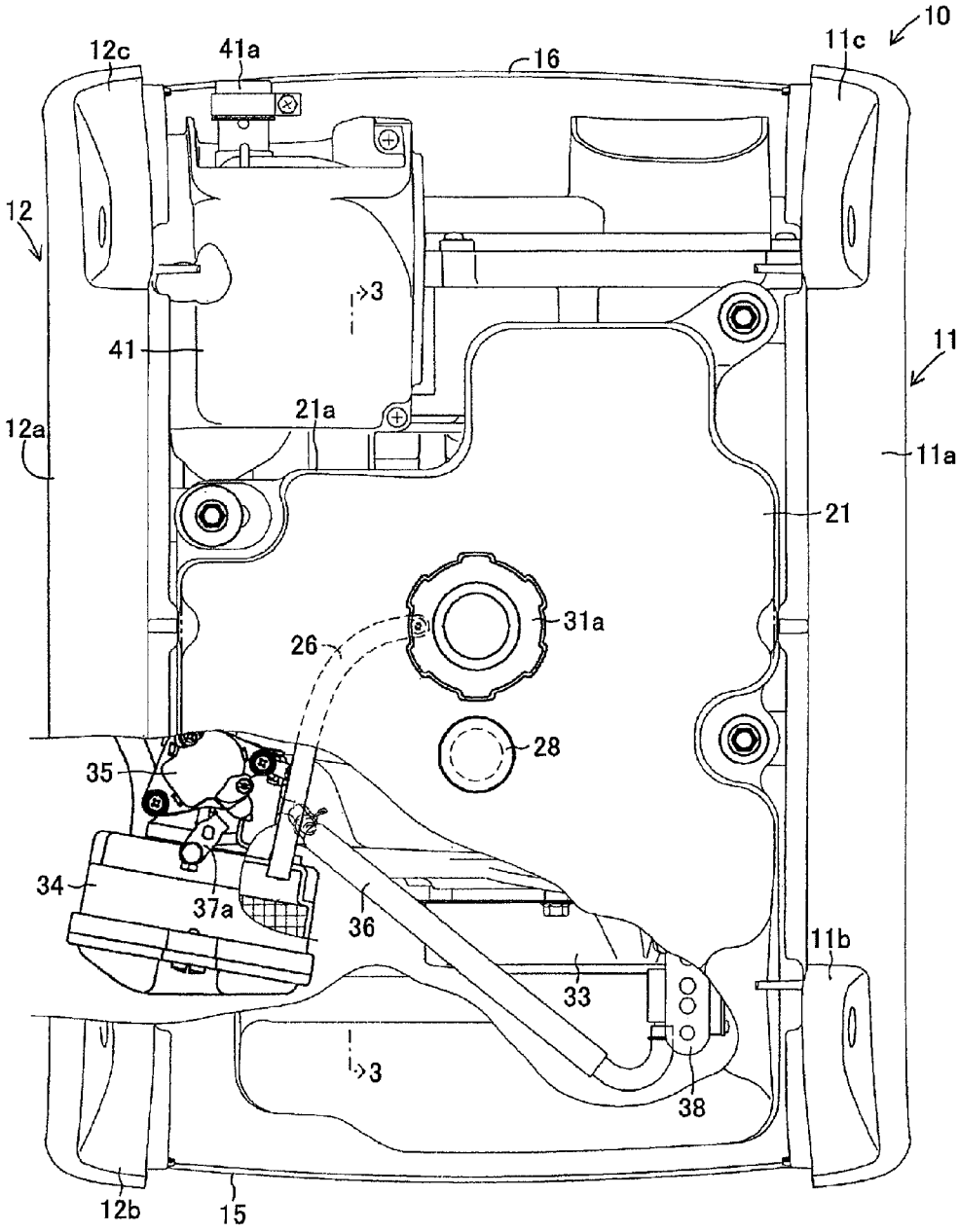
FIG. 2 is a partially cutaway plan view of the engine generator of FIG. 1 showing a fuel vapor discharge structure thereof.

FIG. 2 is a partially cutaway plan view of the engine generator 10 of FIG. 1 showing a fuel vapor discharge structure 20 thereof. With respect to the orientation of the engine generator 10 in FIG. 2, the back portion of the engine generator 10 is located on the left side of FIG. 2. The front portion of the engine generator 10 is located on the right side of FIG. 2. The right side portion of the engine generator 10 has the exhaust cover 16 and is located near the top of FIG. 2. The left side portion of the engine generator 10 has the intake cover 15 and is located near the bottom of FIG. 2. The orientation of components of the engine generator 10 are also described using the terms front, back, left, right and the like as they are defined with respect to the engine generator 10. For example, the right side portion of the fuel tank 21 is the portion that is closest to the top of FIG. 2.

In the illustrated embodiment, the front frame 11 and the rear frame 12 have the same shape and are made of die cast aluminum or the like. The main body portions 11*a*, 12*a* of the front and rear frames 11, 12 are substantially square and are rounded at their upper side portions. The rounded upper side portions of the front frame 11 have a pair of upwardly extending protrusions 11*b*, 11*c*. The rounded upper side portions of the rear frame 12 have a pair of upwardly extending protrusions 12*b*, 12*c*. Rod-like handles 18 (only one side of which is shown in the drawing) are respectively attached to the two opposing pairs of protrusions 11*b*, 12*b* and 11*c*, 12*c*. The pair of handles 18 is used to carry the engine generator 10.

Although not shown, an engine is installed within the interior of the engine generator 10 in the front portion of the engine generator 10. A generator is arranged in the right side portion of the engine generator 10.

Figure 3:
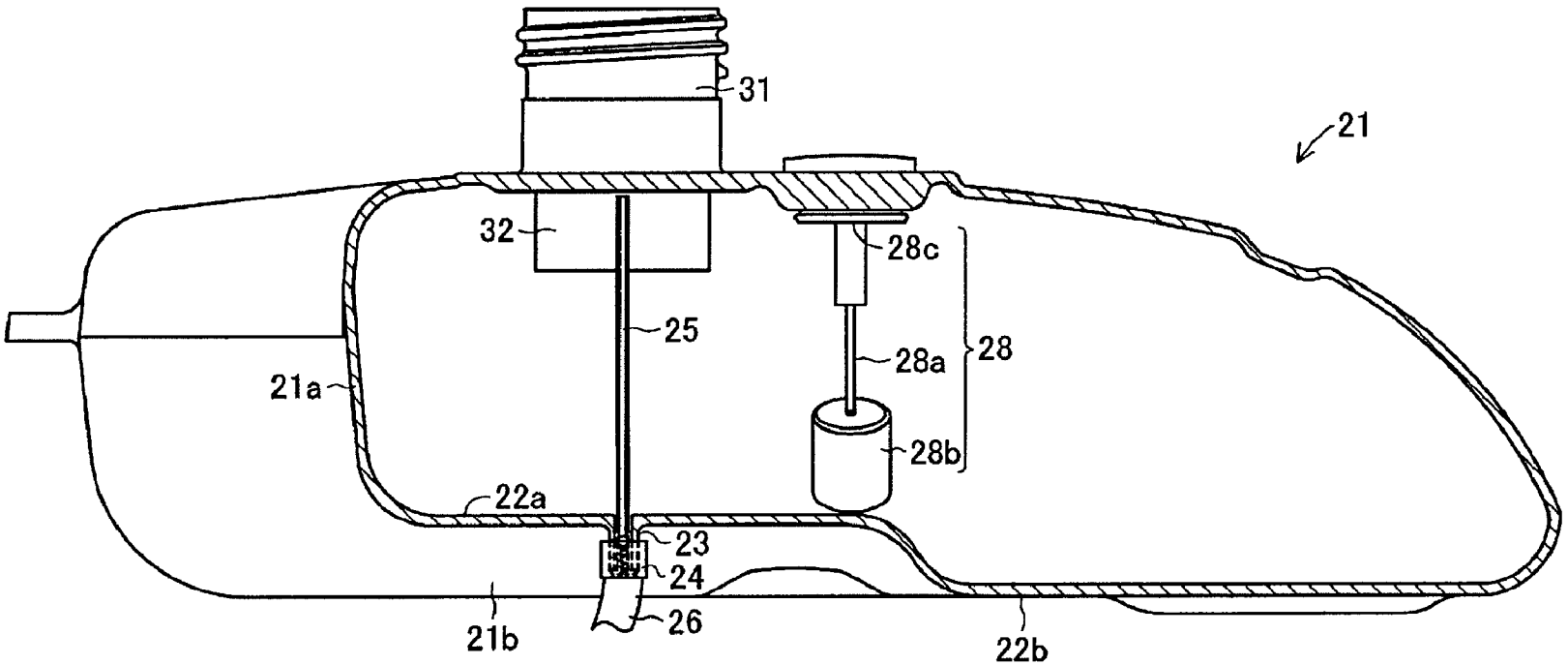
FIG. 3 is a sectional view taken along line 3-3 of FIG. 2 showing a fuel tank having communication tube.

FIG. 3 is a sectional view taken along line 3-3 of FIG. 2 showing a fuel tank 21 having a communication tube 25. The fuel tank 21 is preferably positioned above the engine and the generator. The fuel tank 21 may be made of resin or the like. As most clearly shown in FIG. 2, the rear, right portion of the fuel tank 21 has a recess 21*a*. The front portion of the fuel tank 21 may be wider than the rear portion of the fuel tank 21. As most clearly shown in FIGS. 2 and 3, the rear, left side portion of the fuel tank 21 has a recess 21*b* in its bottom surface. A portion of the bottom surface 22*a* in the recess 21*b* is raised up relative to the adjacent bottom surface 22*b* of the fuel tank 21.

A cylindrical extraction portion 23 may be formed integrally with the fuel tank 21 and extends downward, preferably from the center of the bottom surface 22*a*. The extraction portion 23 may be a separate member attached to the fuel tank 21. The communication tube 25 extends inside the extraction portion 23 and upwards toward an upper portion of the fuel tank 21. The communication tube 25 is preferably constructed from a simple and inexpensive tubular member which can have a variety of cross-sectional shapes (e.g. circular).

A connecting tube 26 is in flow communication with the communication tube 25 and fits around a portion of the extraction portion 23. The communication tube 25, the extraction portion 23, and the connecting tube 26 form a communication passage between the fuel tank 21 and an air cleaner 34.

Preferably, at last a portion of the communication passage within the fuel tank 21 has a tubular shape with its central axis being oriented in a substantially vertical direction. Preferably an end portion of the communication tube 25 is inserted into the extraction portion 23 so as to provide additional stability to the communication tube 25.

Figure 4:
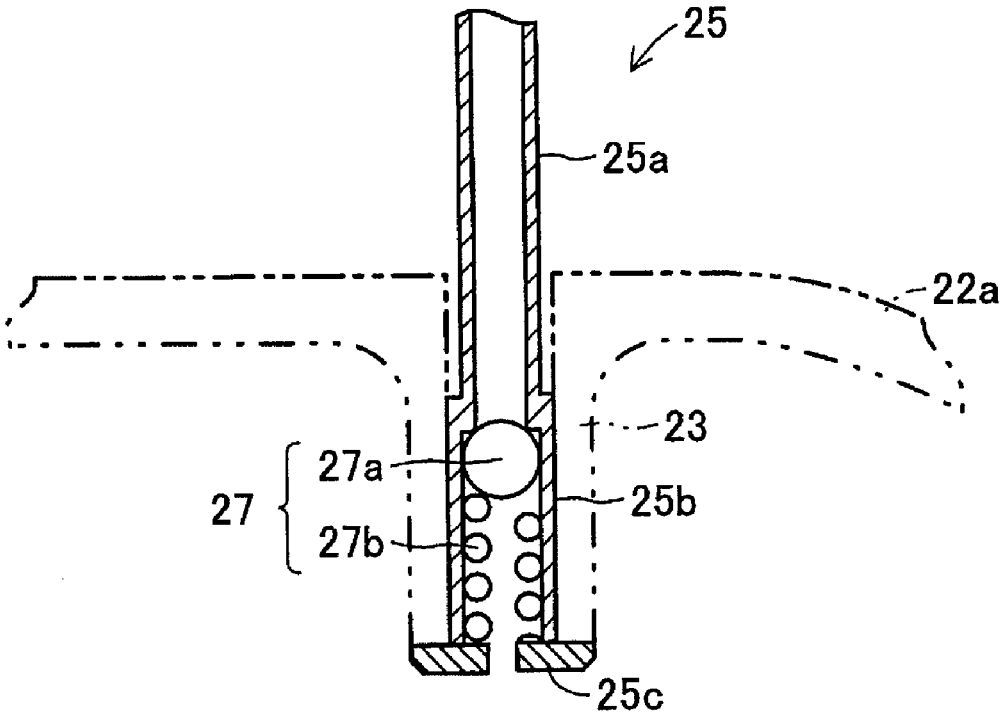
FIG. 4 is a sectional view of a lower portion of the communication tube of FIG. 3 attached to a one-way valve.

FIG. 4 is a sectional view of a lower portion of the communication tube 25 of FIG. 3 attached to a one-way valve 27. In the illustrated embodiment, the communication tube 25 includes an upper portion 25*a*, a valve accommodating portion 25*b*, and a flange portion 25*c*. The upper portion 25*a* extends from the bottom of the fuel tank 21 and towards the top of the fuel tank 21. For example, the upper end of the communication tube 25*a* may extend close to the top surface of the fuel tank 21. The lower end of the communication tube 25 passes through the bottom surface 22*a* of the fuel tank 21 and terminates at the valve accommodating portion 25*b*. The inner and outer diameters of the valve accommodating portion 25*b* may be slightly larger than the inner and outer diameters of the upper portion 25*a* to ease assembly.

The flange portion 25*c* is disposed at the lower end of the valve accommodating portion 25*c* and may have a ring shape. The inner diameter of the flange portion 25*c* is preferably substantially equal to the inner diameter of the tube upper portion 25*a*. The outer diameter thereof is preferably substantially equal to the outer diameter of the extraction portion 23. The flange portion 25*c* can be integrally formed with the valve accommodation portion 25*b* or can be attached to the valve accommodating portion 25*b*. The communication tube 25 can also be attached relative to the fuel tank 21 by other means.

As most clearly shown in FIG. 4, the one-way valve 27 is disposed in the interior of the valve accommodating portion 25*b*. The one-way valve 27 may include a spherical valve member 27*a* and a coil spring 27*b*. The valve member 27*a* is attached to the upper end of the coil spring 27*b*. The lower end of the coil spring 27*b* is disposed on the top surface of the flange portion 25*c*. The coil spring 27*b* biases the valve member 27*a* against the lower end portion of the tube upper portion 25*a* and in a closed position. When pressed against the upper portion 25*a*, the valve member 27*a* inhibits flow between the tube upper portion 25*a* and the valve accommodating portion 25*b*. The valve member 27*a* illustrated in FIG. 4 is in the closed position.

The valve member 27*a* moves to an open position when a predetermined force (e.g., vapor pressure) acts in a downward direction against the valve member 27*a*. The force presses the valve member 27*a* downward and causes the valve member 27*a* to compresses the coil spring 27*b*. With the valve member 27*a* in the open position, flow from the upper portion 25*a* may pass by the valve member 27*a* and into the valve accommodating portion 25*b*.

As most clearly illustrated in FIG. 3, a connection portion 24 connects (e.g., clamps) the connecting tube 26 to the extraction portion 23 of the fuel tank 21. The connecting portion 24 wraps around the end of the connecting tube 26 which is engaged with the outer peripheral portions of the extraction portion 23 and flange portion 25*c*.

The fuel tank 21 may include a remaining fuel quantity detector 28 but is not necessary to be used with the fuel vapor discharge structure 20. The fuel quantity or level detector 28 may be located on the right side of the communication tube 25 as illustrated in FIG. 3. The remaining fuel quantity detector 28 includes a rotary support rod 28*a*, a float 28*b*, and a meter and scale 28*c*. The float 28*b* preferably has a lower specific gravity than the fuel and is attached to the distal end portion of the rotary support rod 28*a*. The rotary support rod 28*a* is mounted so as to be vertically rotatable about a predetermined part of the ceiling portion of the fuel tank 21. The meter and scale 28*c* are disposed at the proximal end portion of the rotary support rod 28*a* and measure the rotation angle of the rotary support rod 28*a*. As the float 28*b* moves in the vertical direction in response to changes in the liquid level of fuel in the fuel tank 21, the rotary support rod 28*a* vertically rotates in accordance with the vertical movement of the float 28*b*. The rotation angle of the rotary support rod 28*a* is determined based on the position of the meter with respect to the scale 28*c*. From the determined value, the remaining quantity of fuel may be determined.

The upper surface of the fuel tank 21 includes a cylindrical fuel supply port 31. As most clearly shown in FIG. 1, the cylindrical fuel supply port 31 extends in an upward direction and through a fuel supply insertion portion 14*a* in the top panel 14. The cylindrical fuel supply port 31 is preferably disposed near the center of the fuel tank 21. A tank cap 31*a* is detachably attached to the upper end of the fuel supply port 31.

As illustrated in both FIGS. 1 and 3, the fuel tank 21 also can include a one-way valve 32 disposed within the fuel tank 21 and below the fuel supply port 31. When the pressure inside the fuel tank 21 drops below a predetermined pressure to cause a negative pressure relative to atmospheric pressure, the one-way valve 32 opens so as to allow gas outside the tank that has a higher pressure into the fuel tank 21. The outside gas inhibits the pressure in the fuel tank 21 from dropping any further.

As most clearly shown in FIG. 2, the engine generator 10 includes an intake fan portion 33 and an air cleaner 34. The intake fan portion 33 is mounted behind the intake cover 15 (see FIG. 2) and draws outside gas into the engine generator 10. The air cleaner 34 is preferably disposed midway between the bottom panel 17 and the top of the engine generator 10 and, most preferably, in the left-rear region of the engine generator 10. The engine generator 10 includes a carburetor 35 disposed between the air cleaner 34 and the center of the engine generator 10. In operation, outside air drawn in by the intake fan portion 33 is cleaned by the air cleaner 34 before being routed to the carburetor 35.

As most clearly shown in FIG. 2, the lower end of the connecting tube 26 connects to an induction system so as to feed the fuel vapors to the engine. The induction system includes an air induction system and a fuel system. The induction system may include a carburetor 35 as shown in FIG. 2 and an air filter 34 located upstream of the carburetor 35. Alternatively, the induction system may include one or more fuel injectors to introduce fuel into the induction system, the engine cylinder(s) or into both. Accordingly, the lower end of the connecting tube 26 may terminate at a housing of the air filter 34 as illustrated in FIG. 2 or at another location within the induction system depending on the type of induction system employed with the engine generator 10.

Thus, fuel vapor leaving the fuel tank 21 enters the communication tube 25 which connects to the extraction portion 23. The fuel vapor then passes through the extraction portion 23 and enters the connecting tube 26 before reaching the induction system. The communication tube 25, the extraction portion 23, and the connecting tube 26 form the communication passage between the fuel tank 21 and the induction system. A pressure rise in the fuel tank 21 causes the fuel vapor to flow through the communication passage, into the induction system, and then into the engine. The fuel vapor combines with the outside air drawn in by the intake fan portion 33.

The engine generator 10 further includes a fuel pipe 36, a choke cable 37, and a fuel cock 38. The fuel cock 38 may include a cock operating portion 38*a* and a fuel supply portion 38*b*. The fuel supply portion 38*b* is connected to the fuel tank 21. An end of the fuel pipe 36 and an end of the choke cable 37 are both connected to the carburetor 35. The other end of the fuel pipe 36 is connected to the fuel cock 38. The cock operating portion 38*a* and the fuel supply portion 38*b* are connected to the fuel cock 38. When the fuel cock 38 is opened by operating the cock operating portion 38*a*, the fuel in the fuel tank 21 is supplied to the carburetor 35. When the fuel cock 38 is closed, the supply of fuel from the fuel tank 21 to the carburetor 35 is stopped.

In the illustrated embodiment, the fuel supplied from the fuel tank 21 to the carburetor 35 is mixed with the air supplied from the air cleaner 34 to the carburetor 35. The air-fuel mixture is supplied to the engine via an intake passageway (not shown). The other end of the choke cable 37 is connected to a choke operating portion (not shown). The choke operating portion is accessible through the front panel 13. The choke operating portion is linked to the choke lever 37*a* via the choke cable 37. By operating the choke operating portion, the concentration of the air-fuel mixture is adjusted. The fuel-air mixture may be adjusted by, for example, pulling the choke operating portion to increase the concentration of the fuel which reduces the amount of air supplied from the air cleaner 34 to the carburetor 35.

A recoil handle (not shown) allows a user to start the engine and is accessible through the front panel 13. The recoil handle connects to a recoil starter 39*a* via a recoil rope 39. The recoil starter 39*a* is coupled to the crankshaft (not shown) of the engine. When the recoil handle is pulled, the recoil starter 39*a* rotates the crankshaft to start the engine.

Although not shown, the engine generator 10 includes an ignition plug and a muffler 41. The muffler 41 is disposed on the exhaust side of the engine (the exhaust cover 16-side rear portion of the engine generator 10). The ignition plug ignites the air-fuel mixture supplied by the carburetor 35. The ignited air-fuel mixture explodes within the engine to thereby start the engine. Further, the discharged exhaust gas is routed through the muffler 41 before reaching the outside environment.

The engine generator 10 may be activated by opening the cock operating portion 38*a* to allow fuel to flow from the fuel tank 21 to the carburetor 35. Next, the choke operating portion is pulled to reduce the supply of air flowing from the air cleaner 34 to the carburetor 35. The recoil handle is pulled to start the engine. As the engine starts and warms up, the choke operating portion is returned to the original state. In the original state the concentration of the fuel supplied to the engine is suitable for normal engine operation.

The electric power generated by the engine generator 10 is provide to other equipment by connecting the other equipment to the engine generator 10 via a cord. When the fuel in the fuel tank 21 evaporates and the gas/vapor pressure inside the fuel tank 21 exceeds a predetermined value, the coil spring 27*b* of the one-way valve 27 compresses so that the valve member 27*a* moves in a downward direction within the valve accommodating portion 25*b* to an open position. When in the open position, the tube upper portion 25*a* is in flow communication with the valve accommodating portion 25*b* and allows fuel vapor inside the fuel tank 21 to discharge into the induction system by way of the communication tube 25 and the connecting tube 26.

The fuel vapor is routed to the carburetor 35 together with the induction air. When the pressure inside the fuel tank 21 becomes a negative pressure relative to atmospheric pressure and equal to or lower than the predetermined value, the one-way valve 32 attached to the tank cap 31*a* opens so as to allow outside air to flow into the fuel tank 21. The pressure inside the fuel tank 21 is thus maintained within a predetermined range. The remaining fuel quantity detector 28 determines the remaining quantity of fuel in the fuel tank 21. Fuel is fed when the remaining fuel quantity becomes small.

The fuel vapor discharge structure 20 adjusts for high fuel tank pressures by allowing the fuel vapor to discharge to the induction system via the communication passage. The communication passage is formed by the communication tube 25 within the fuel tank 21 and the connecting tube 26 outside the fuel tank 21. The communication tube 25 connects to the connecting tube 26 via the extraction portion 23. The extraction portion 23 is formed at the bottom surface portion 22*a* of the fuel tank 21. Accordingly, the connecting tube 26 is located below the fuel tank 21 in an otherwise unused or dead space. Preferably, the connecting tube 26 does not project beyond the outer periphery of the fuel tank 21 so as to not be obtrusive when operating the engine generator 10.

Since the communication tube 25 is disposed within the fuel tank 21, the communication tube 25 is hidden and is not visible from outside the fuel tank 21. The air cleaner 34 is preferably at least partially disposed below the fuel tank 21. A distal end portion of the communication passage located outside the fuel tank 21 is in flow communication with the induction system. Generally, in an engine apparatus, the fuel tank 21 and the air cleaner 34 are arranged so as to be close to each other. By locating the air cleaner 34 near to the fuel tank 21, a shorter connecting tube 26 between the air cleaner 34 and the fuel tank 21 may be used which results in a more compact installation. Preferably, the communication tube 25 and the connecting tube 26 have a tubular shape with the extraction portion 23 having a cylindrical portion so that the communication tube 25 and the connecting tube 26 can be securely fixed by means of a simple and inexpensive member or the like.

The recess 21*b* formed at the bottom portion of the fuel tank 21 in the region of the extraction portion 23 allows the extraction portion 23 to not project in a downward direction beyond the bottom surface of the fuel tank 21. With the bottom of the extraction portion 23 positioned this way, it is unlikely that the components of the engine generator 10 located below the fuel tank 21 will contact the extraction portion 23 even when the engine vibrates and moves as it is driven. Further, the one-way valve 27, which opens when the fuel vapor pressure exceeds a predetermined value, inhibits the flow of fuel vapor to the induction system and outside the engine when the fuel vapor pressure does not exceed the predetermined value.

The one-way valve 27 is easy to install and the communication tube 25 is stably secured since the valve accommodating portion 25*b* is inside the extraction portion 23. The one-way valves 32 of the tank cap 31*a* allows the introduction of air from outside the engine when there is negative pressure equal to or lower than a predetermined pressure within the fuel tank 21. The pressure within the fuel tank 21 is thus maintained within a predetermined range at all times.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof.

For example, the fuel-vapor discharge structure is not limited to that of the embodiment described above but can be modified and implemented as appropriate. For example, while in the above-described embodiment the one-way valve 27 is placed within the valve accommodating portion 25*b* formed at the lower end portion of the communication tube 25, the one-way valve 27 may be placed in any portion of the communication passage. Further, while in the above-described embodiment the extraction portion 23 is formed integrally with the fuel tank 21, the extraction portion 23 may be formed with a member separate from the fuel tank 21. Further, the extraction portion may be provided on the side above the bottom surface portion 22*a*, with the lower end portion of the extraction portion being engaged with the outer peripheral portion of the extraction portion.

Further, the connecting tube may be inserted and fixed in the interior of the extraction portion. Further, while in the above-described embodiment the engine apparatus used is the engine generator 10, the engine apparatus is not limited to the engine generator 10 but may be a general-purpose engine, an engine drive pump, an engine mower, or the like. Further, the other structures of the engine generator 10, the other portions constituting the engine generator 10, and the like may also be modified as appropriate within the technical scope of the present invention.

In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims.

What is claimed is:

1. A fuel-vapor discharge structure for a fuel tank comprising:

a communication passage between an upper space of a fuel tank and outside of the fuel tank;

an extraction portion disposed at a bottom of the fuel tank, wherein a portion of the communication passage includes a conduit having an upper portion terminating at an open end of the conduit and a lower portion extending into the extraction portion so as to support the entire conduit within the fuel tank in an erect configuration;

an air induction system, wherein a distal end portion of the communication passage disposed outside the fuel tank is in flow communication with the air induction system so that fuel-vapor from the upper space enters the engine; and a one-way valve disposed in the fuel tank and configured to allow fuel-vapor to pass from the conduit to the air induction system only when a fuel vapor pressure of the fuel vapor exceeds a predetermined pressure.

2. The fuel-vapor discharge structure according to claim 1, wherein a portion of the communication passage located between the extraction portion and the upper space is a communication tube having its axis oriented in a substantially vertical direction.

3. The fuel-vapor discharge structure according to claim 2 further comprising a cylindrical portion projecting downward from the bottom of the fuel tank, and wherein a lower end portion of the communication tube is connected to the cylindrical portion.

4. The fuel-vapor discharge structure according to claim 3 further comprising a recess, the recess being formed in the bottom of the fuel tank, and wherein the extraction portion is disposed within the recess.

5. The fuel-vapor discharge structure according to claim 3, wherein a portion of the communication tube on the outside of the fuel tank is formed with a connecting tube connected to the extraction portion.

6. The fuel-vapor discharge structure according to claim 1 further comprising a one-way valve disposed within the communication passage, the one-way valve being adapted to open when a fuel vapor pressure exceeds a predetermined value.

7. The fuel-vapor discharge structure according to claim 3, wherein the one-way valve is disposed within a hole in the extraction portion.

8. The fuel-vapor discharge structure according to claim 1, wherein the distal end portion of the communication passage is in flow communication a portion of the air induction system disposed below the fuel tank.

9. The fuel-vapor discharge structure according to claim 1, wherein the portion of the air induction system is disposed directly beneath the fuel tank.

10. The fuel-vapor discharge structure according to claim 1, wherein the extraction portion comprises a cylindrical projection extending downwardly from a bottom of the fuel tank, the lower portion of the conduit being cylindrical and being fit into the cylindrical portion of the extraction portion so as to support the entire conduit within the fuel tank.

11. The fuel-vapor discharge structure according to claim 10, wherein the one-way valve is disposed within the cylindrical portion of the conduit which is disposed in the cylindrical portion of the extraction portion.

12. A fuel-vapor discharge system for a fuel tank comprising:

a communication passage between an inside and outside of a fuel tank, a portion of the communication passage being disposed within the fuel tank, the communication passage comprising a conduit having an upper portion terminating at an open end disposed in an upper portion of the fuel tank;

an extraction portion being disposed at the bottom of the fuel tank, wherein the conduit further comprises a lower portion extending into the extraction portion;

a one-way check valve disposed within the lower portion of the communication passage and configured to allow fuel vapor to pass only when a fuel vapor pressure of the fuel vapor exceeds a predetermined pressure; and an induction system in flow communication with the communication passage.

13. The fuel-vapor discharge system according to claim 12, wherein the one-way check valve is disposed within the extraction portion.

14. The fuel-vapor discharge system according to claim 12, wherein the extraction portion is a separate member attached to the fuel tank.

15. The fuel-vapor discharge structure according to claim 12, wherein the induction system includes an air filter and a carburetor located downstream of the air filter.

16. The fuel-vapor discharge structure according to claim 12, wherein a portion of the communication passage between the inside and outside of the fuel tank has an axis that is disposed in a substantially vertical direction.

17. The fuel-vapor discharge structure according to claim 12, wherein at least a portion of the extraction portion is cylindrically shaped and projects from a bottom surface of the fuel tank in a downward direction.

18. The fuel-vapor discharge structure according to claim 12, wherein at least a portion of the communication tube disposed outside the fuel tank includes a connecting tube, the connecting tube being connected to the extraction portion.

19. The fuel-vapor discharge structure in a fuel tank for an engine apparatus according to claim 12 further comprising a one-way valve, the one-way valve being disposed in the communication passage and being configured to open when vapor pressure within the fuel tank exceeds a predetermined value.

20. The fuel-vapor discharge system according to claim 12, wherein the communication passage is in flow communication a portion of the air induction system disposed below the fuel tank.

21. The fuel-vapor discharge system according to claim 12, wherein the portion of the air induction system is disposed directly beneath the fuel tank.

22. A fuel tank for an engine generator comprising:

a lower surface;

an internal upper region;

a member having at least a portion disposed within the fuel tank, the portion including an internal passageway that extends between the upper region and the lower surface;

an extraction portion disposed on the lower surface and in flow communication with internal passageway, the portion of the member extending into the extraction portion so as to support the entire portion within the fuel tank and wherein a size of the extraction portion is configured to allow the portion of the member to be inserted into the fuel tank through the extraction portion; and an air induction system in flow communication with the internal passageway so that fuel-vapor from the internal upper region enters the engine generator.

23. The fuel tank according to claim 22, wherein the extraction portion is integral to the fuel tank.

24. The fuel tank according to claim 22, wherein at least a portion of the member has an axis that is disposed in a substantially vertical direction.

25. The fuel tank according to claim 22, wherein at least a portion of the extraction portion has a cylindrically shape and projects from the lower surface in a downward direction.

26. The fuel tank according to claim 22 further comprising a one-way valve disposed within the extraction portion, the one-way valve being adapted to open when a fuel vapor pressure within the fuel tank exceeds a predetermined value.

27. The fuel tank according to claim 14, wherein the communication passage is in flow communication a portion of the air induction system disposed below the fuel tank.

28. The fuel tank according to claim 22, wherein the portion of the air induction system is disposed directly beneath the fuel tank.

29. The fuel tank according to claim 22 additionally comprising a one-way check valve disposed within the portion of the member and the extraction portion.

* * * * *

UNITED STATES PATENT AND TRADEMARK OFFICE

CERTIFICATE OF CORRECTION

PATENT NO. : 7,540,276 B2
APPLICATION NO. : 11/511525
DATED : June 2, 2009
INVENTOR(S) : Satoshi Makino It is certified that error appears in the above-identified patent and that said Letters Patent is hereby corrected as shown below:

Column 2, Line 30, after "examples" insert -- and --.

Column 2, Line 40, after "having" insert -- a --.

Column 10, Line 49, in Claim 27, change "14," to -- 22, --.

Signed and Sealed this

Thirtieth Day of March, 2010

David J. Kappos

David J. Kappos
*Director of the United States Patent and Trademark Office*